US008844630B2

(12) United States Patent
Smith

(10) Patent No.: US 8,844,630 B2
(45) Date of Patent: Sep. 30, 2014

(54) ADJUSTABLE ENGAGEMENT SYSTEM FOR TOOL REMOVAL AND METHOD OF USE

(75) Inventor: Malcolm D. Smith, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 458 days.

(21) Appl. No.: 13/406,692

(22) Filed: Feb. 28, 2012

(65) Prior Publication Data

US 2013/0220617 A1 Aug. 29, 2013

(51) Int. Cl.
*E21B 31/00* (2006.01)

(52) U.S. Cl.
USPC ..... 166/301; 166/99; 294/86.1

(58) Field of Classification Search
CPC ..... E21B 31/20; E21B 23/00; E21B 23/03
USPC ..... 166/301, 99, 117.7; 294/86.24, 86.1
See application file for complete search history.

(56) References Cited

U.S. PATENT DOCUMENTS

| | | | | | |
|---|---|---|---|---|---|
| 2,680,483 | A * | 6/1954 | Le Bus | 166/298 |
| 2,771,957 | A * | 11/1956 | Weber | 279/2.12 |
| 2,832,423 | A * | 4/1958 | Hall | 166/334.1 |
| 3,765,487 | A * | 10/1973 | McEver | 166/301 |
| 3,809,161 | A * | 5/1974 | Carothers | 166/301 |
| 2009/0056497 | A1 * | 3/2009 | Swinford | 74/640 |

* cited by examiner

*Primary Examiner* — David Bagnell
*Assistant Examiner* — Tara Schimpf
(74) *Attorney, Agent, or Firm* — Shawn Hunter

(57) ABSTRACT

A retrieval tool and method for retrieving a remote tool with a threaded connection from a remote location. The retrieval tool includes a rotational drive member which rotates an attachment sub having a complimentary threaded portion. An articulated shaft assembly permits the attachment sub to move laterally and angularly with respect to the axis of the rotational drive member. A fluid conduit supplies fluid pressure for releasing the remote tool.

17 Claims, 12 Drawing Sheets

ADJUSTABLE ENGAGEMENT SYSTEM FOR TOOL REMOVAL AND METHOD OF USE

BACKGROUND OF THE INVENTION

1. Field of the Invention

The invention relates generally to devices and methods for engaging and removing remote tools having threaded portions from a remote location. In particular aspects, the invention relates to devices and methods for removing certain threaded tools from a subterranean wellbore.

2. Description of the Related Art

A number of well tools are employed that are left in the wellbore disconnected from a running or retrieval string. In some cases, these tools are difficult to secure and remove since they present a neck portion that is offset or at an angle with respect to the axis of the wellbore. This generally includes any tool that is left in the wellbore at an angle to the main wellbore axis and is not connected to a running or retrieval string (e.g., directional drilling or driving tools). In addition, some tools require the application of fluid pressure to release them from the wellbore.

SUMMARY OF THE INVENTION

The invention provides devices and methods for removal of a tool from a remote location such as a subterranean wellbore. A retrieval tool is described that generally includes an outer housing, an rotational drive element and an articulated shaft assembly that carries an attachment sub. The attachment sub has a threaded portion that is complimentary to the threaded neck portion of the remote tool to be retrieved. In a described embodiment, the outer housing and rotational drive element are used to locate and guide the attachment sub onto the neck portion of the remote tool so that it can be threadedly attached to the neck portion.

The outer housing includes a locating plate with an opening that is shaped and sized to receive the neck portion of the remote tool. The opening is offset from the central axis of the wellbore and functions to capture the neck portion of the remote tool. In addition, the opening in the locating plate functions to position the attachment sub so that it can be further guided toward the neck portion.

In a described embodiment, a guide sleeve with an enlarged opening radially surrounds the threaded portion of the attachment sub to assist in capture of the neck portion. In the described embodiment, the guide sleeve includes a tapered edge guide portion that assists in guiding the attachment sub toward the neck portion of the remote tool.

Also in described embodiments, a positioning assembly is retained within the inner body and functions to govern angular and lateral orientation of the attachment sub so that it can be readily affixed by threading to the neck portion. In a described embodiment, the positioning assembly includes a number of plates and rings that are in a stacked configuration and retain the attachment sub in a captive arrangement. The plates and rings are able to move laterally with respect to one another, thereby governing orientation of the attachment sub. In described embodiments, the positioning assembly also includes an articulated shaft assembly made up of a set of yokes and shafts to alter orientation of the attachment sub.

In featured embodiments, a clutch assembly operably interconnects the rotational drive member with the outer housing. The clutch assembly functions to release the outer housing from fixed attachment with the rotational drive member and articulated shaft assembly so that the rotational drive assembly will apply torque to the attachment sub following seating of the attachments sub onto the threaded portion of the remote tool. The clutch assembly allows the attachment sub to be threaded onto the neck portion of the remote tool after the neck portion has been captured by the retrieval device. The clutch assembly includes frangible shear members that are broken in order to free the outer body from the inner body and articulated shaft portion. Also in a described embodiment, the clutch assembly includes a key and slot arrangement that allows the outer housing to be carried by the rotational drive member after the shear members are broken.

In described embodiments, the retrieval device includes a fluid conduit that extends through the interior of the rotational drive member, articulated shaft assembly and attachment sub. Preferably, the fluid conduit is operably interconnected with a fluid pump at surface so that fluid pressure may be supplied through the conduit to the remote tool to be retrieved. This features assists in tool removal in instances where application of fluid pressure is used to release the tool within a wellbore from either the wellbore or interconnected tools within the wellbore.

In an exemplary described method of operation, a retrieval device constructed in accordance with the invention is secured to a rotatable running string and disposed within a remote location such as a wellbore which contains the remote tool to be removed. The retrieval device is placed proximate the remote tool. Rotation of the running string will rotate the retrieval device, including the outer housing. As the retrieval device is rotated by the running string, the neck portion of the remote tool becomes aligned with the opening in the locating plate of the retrieval device. The neck portion passes through the locating plate opening and positions the attachment sub in the correct orientation relative to the neck portion. The guide sleeve guides the attachment sub into the thread of the neck portion. The positioning assembly permits the attachment sub to be angled and moved laterally as necessary to be threaded into engagement with the remote tool via rotation of the running string.

Once the attachment sub has been threadedly engaged with the remote tool, the running string, retrieval tool and remote tool are withdrawn from the remote location.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
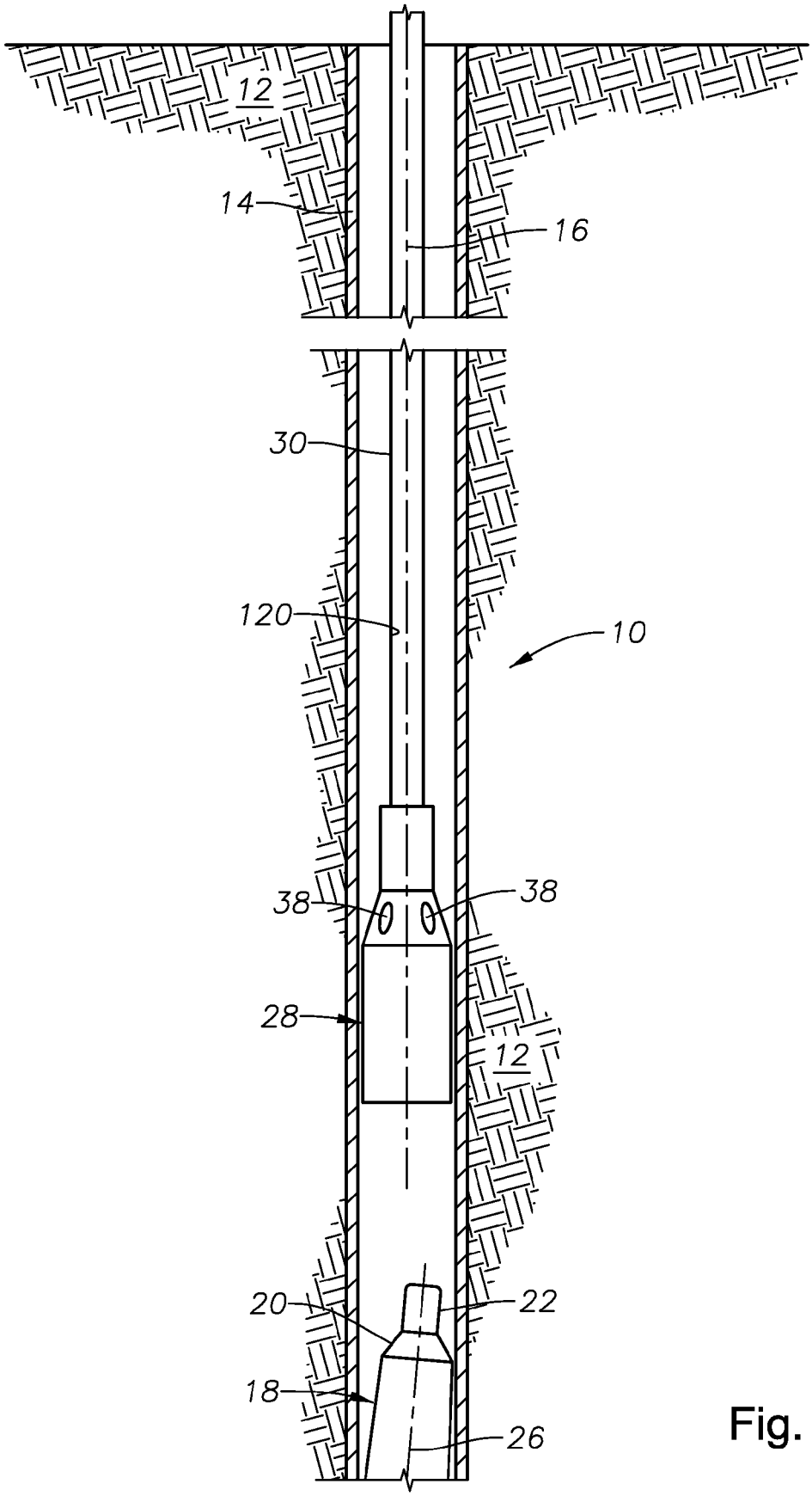
FIG. 1 is a side, cross-sectional view of a wellbore containing a remote tool to be removed and a retrieval tool constructed in accordance with the present invention.

FIG. 1 illustrates an exemplary wellbore 10 that has been drilled through the earth 12 and has been lined with metallic casing 14. The wellbore 10 has a central axis, which is illustrated by the dashed line 16. A remote tool 18 to be removed is located within the wellbore 10. In the described embodiment, the remote tool 18 is releasably secured either to the wellbore 10 itself or to another tool (not shown) within the wellbore 10 and requires the application of a particular amount of fluid pressure to the upper portion of the remote tool 18 in order to release the remote tool 18 and allow it to be removed from the wellbore 10. The remote tool 18 has a shoulder 20 with a neck portion 22 that extends axially upwardly from the shoulder 20. As can be seen in FIG. 2B, the neck portion 22 has an interior threaded portion 24, by which the remote tool 18 is secured for removal from the wellbore 10. It is noted that, in this example, the remote tool 18 has a central axis 26 that is angularly offset from the axis 16 of the wellbore 10. In addition, in this example, the neck portion 22 is radially or laterally offset from the central axis 16 of the wellbore 10.

A retrieval tool 28, which is constructed in accordance with the present invention, is shown disposed within the wellbore 10 by a rotary running string 30. The running string 30 may be formed of a number of production tubing string sections that are secured together in an end-to-end fashion. Alternatively, the running string 30 may be coiled tubing.

Figure 2A:
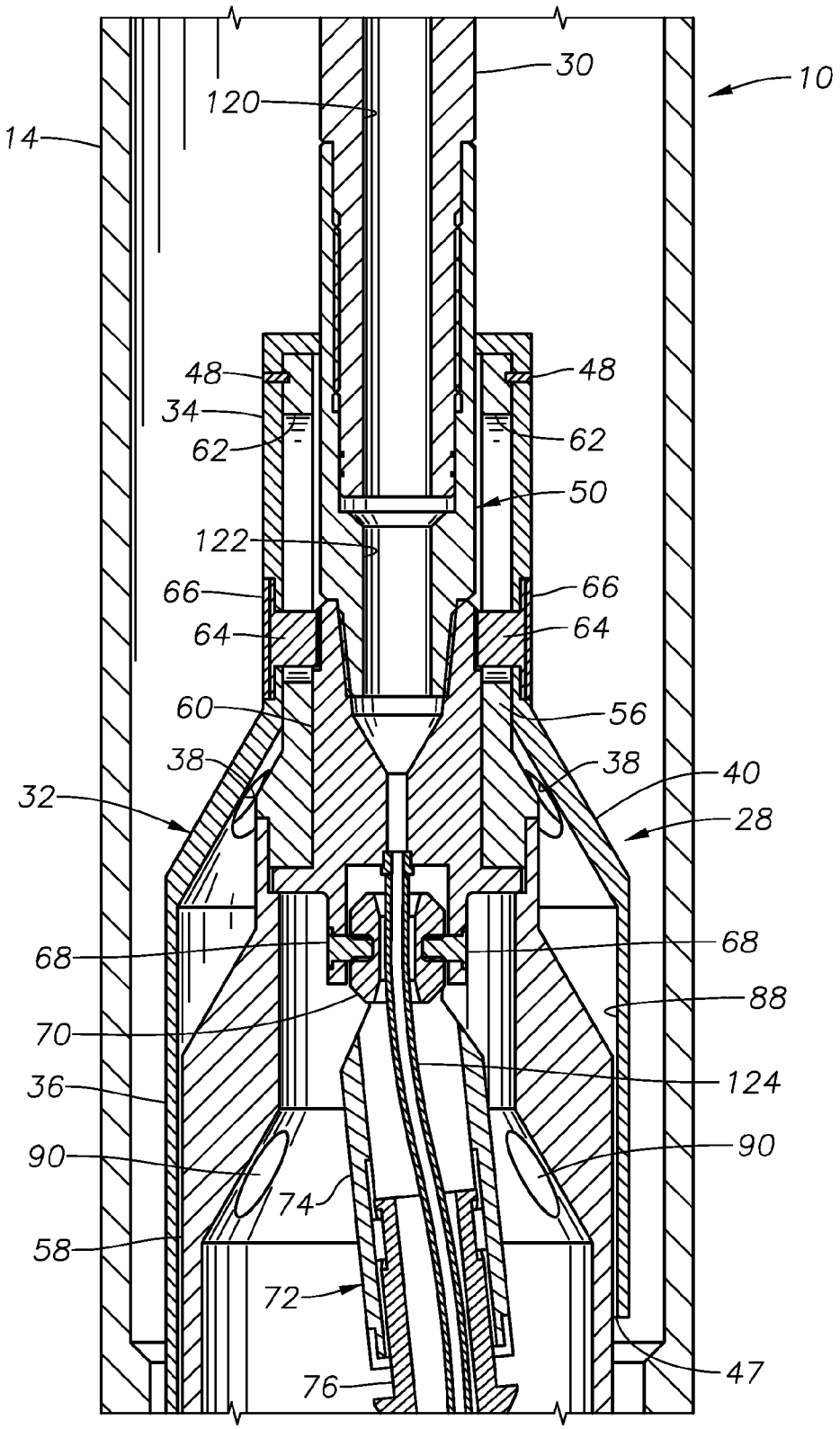
FIGS. 2A and 2B are an enlarged side, cross-sectional view of the retrieval tool and remote tool of FIG. 1 during running in of the retrieval tool.
Figure 2B:
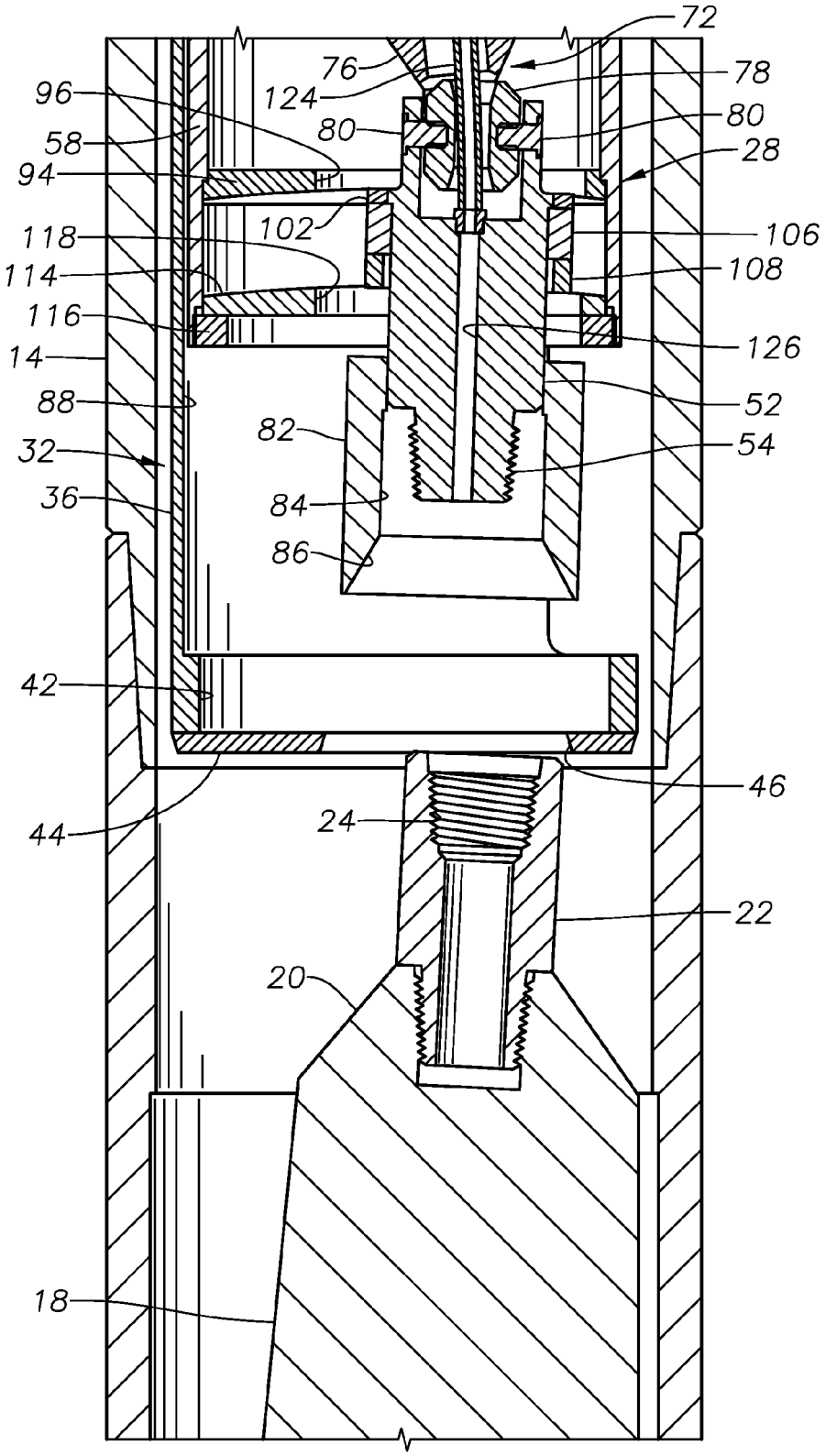

An exemplary retrieval tool 28 in depicted in greater detail in FIGS. 2A-2B and includes a generally bell-shaped outer housing 32. In the depicted example, the outer housing 32 includes an upper, reduced diameter portion 34 and a lower, enlarged diameter portion 36. Openings 38 are disposed through the angled shoulder 40 that interconnects the upper portion 34 with the lower portion 36. The openings 38 allow fluid bypass when running in and help to reduce the overall weight of the retrieval tool 28. The lower end of the lower portion 36 presents an opening 42 that is closed off by a locating plate 44. The locating plate 44 includes an elongated opening 46 that is shaped and sized to receive the neck portion 22 of the remote tool 18. Additionally, in certain embodiments, there is a lateral opening 47 that is formed within the lower portion 36. The lateral opening 47 provides clearance for interior shaft elements at high angles of deviation and allows access to inner components during assembly, maintenance and operation.

The outer housing 32 is releasably secured by frangible shear members 48 to an articulated shaft assembly, generally shown at 50. Preferably, the shear members 48 are disposed through the upper, reduced diameter portion 34 of the outer housing 32. When the shear members 48 are intact, the rotational drive element (described shortly) will transmit torque to the outer housing 32. The articulated shaft assembly 50 functions to allow lateral and angular movement of an attachment sub 52 within the outer housing 32. The attachment sub 52 includes a threaded portion 54 that is complimentary to the threaded portion 24 of the remote tool 18.

The exemplary articulated shaft assembly 50 includes an inner body top sub 56 which is affixed at its lower end to an inner body 58. A rotational drive element 60 is disposed radially within the inner body top sub 56. The rotational drive element 60 is rotated by the running string 30 and will transmit torque to other components of the retrieval tool 28 as described herein. It is noted that the shear members 48 interconnect the outer housing 32 to the inner body top sub 56. Elongated slots 62 are formed within the inner body top sub 56. A retainer key 64 is disposed within each slot 62. The retainer keys 64 are secured in place against the rotational drive element 60 by securing plates 66. When the shear members 48 are used to interconnect the outer housing 32 to the rotational drive element 60, the retainer keys 64 are located proximate the lower ends of the elongated slots 62. It should be understood that the retrieval tool 28 features a clutch assembly that includes the shear members 48, retainer keys 64 and slots 62. The clutch assembly of the retrieval tool 28 allows the rotational drive element 60 to be selectively released from fixed engagement with the outer housing 32 so that the rotational drive element 60 will thereafter primarily apply torque to the attachment sub 52 to drive it into threaded engagement with the neck portion 22 of the remote tool 18. The outer housing 32 will still rotate with the inner body 58 and flex joint top sub 60 due to the presence of the retainer keys 64 within slots 62. However, torque is now applied from the rotational drive element 60 to the attachment sub 52 via the telescopic shaft assembly 72 (described shortly) after the shear members 48 are broken.

Figure 9:
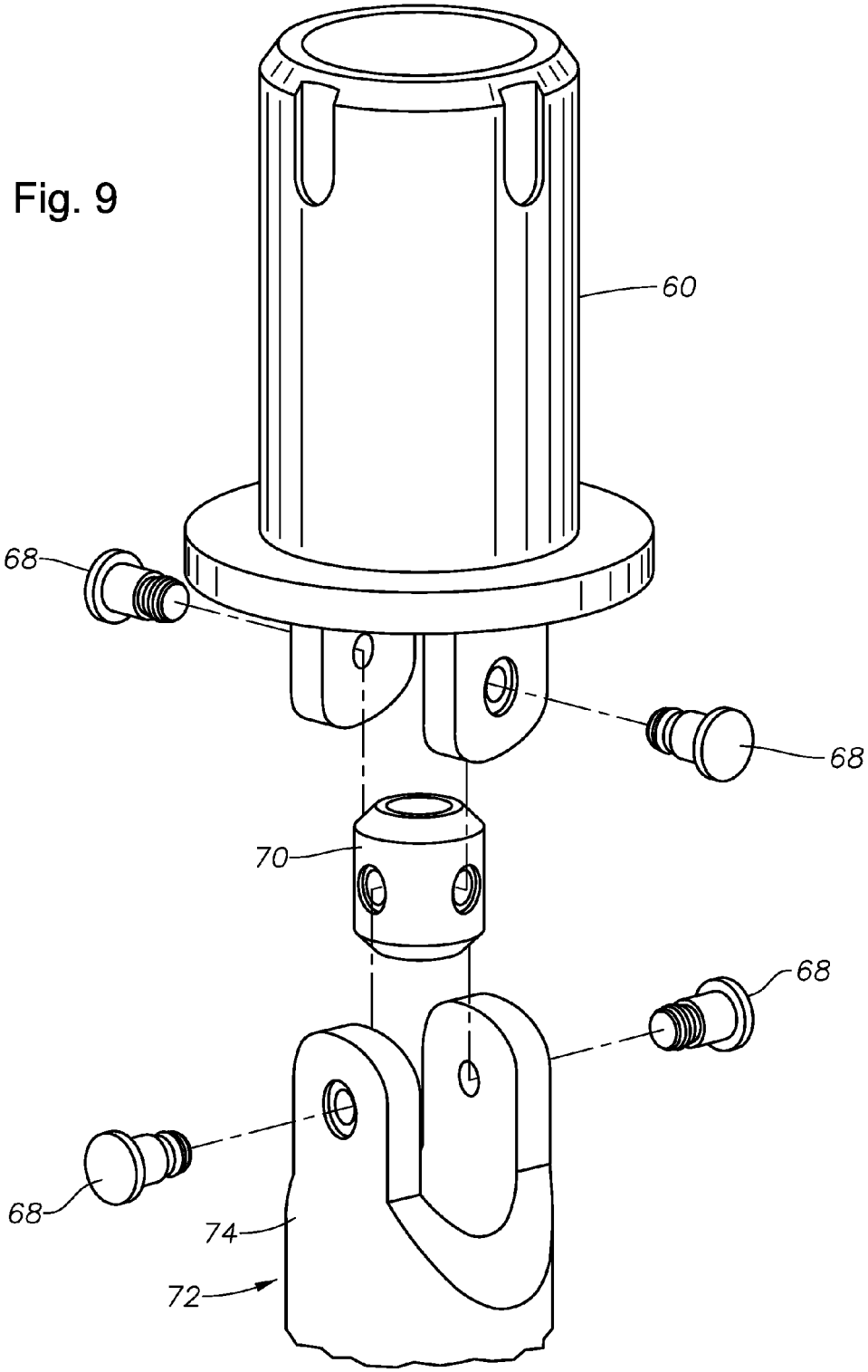
FIG. 9 is an exploded, isometric view of portions of an exemplary articulated shaft assembly used within the retrieval tool.

The lower end of the rotational drive element 60 is affixed by pins 68 to an upper flex joint yoke 70. The yoke 70 is affixed to a telescopic shaft assembly 72 also using pins 68. FIG. 9 is an exploded view that helps illustrate an exemplary connection of the yoke 70 with neighboring components. The shaft assembly 72 is made up of an upper keyed shaft 74 and a lower keyed shaft 76. The upper keyed shaft 74 receives the lower keyed shaft 76 in a nested configuration, and the two are capable of telescopic movement with respect to each other between extended and retracted positions. The lower shaft 76 is affixed to a lower flex joint yoke 78, and the lower flex joint yoke 78 is, in turn, interconnected by pins 80 to the attachment sub 52. Interconnection of the lower flex joint yoke 78 with neighboring components is done in a manner similar to that of the upper yoke 70. A cylindrical guide sleeve 82 radially surrounds the attachment sub 52 and is attached to it. Preferably, the guide sleeve 82 presents an enlarged lower opening 84 with a tapered edge 86 to serve as a guide portion. It is noted that the lower opening 84 should be substantially aligned with the opening 46 of the locating plate 44 (see FIG. 3B).

The outer housing 32 defines an interior chamber 88, and the inner body 58 resides within the chamber 88. Openings 90 are disposed through the inner body 58. The openings 90 allow fluid bypass when running in and also help to reduce the weight of the retrieval tool 28.

Figure 6:
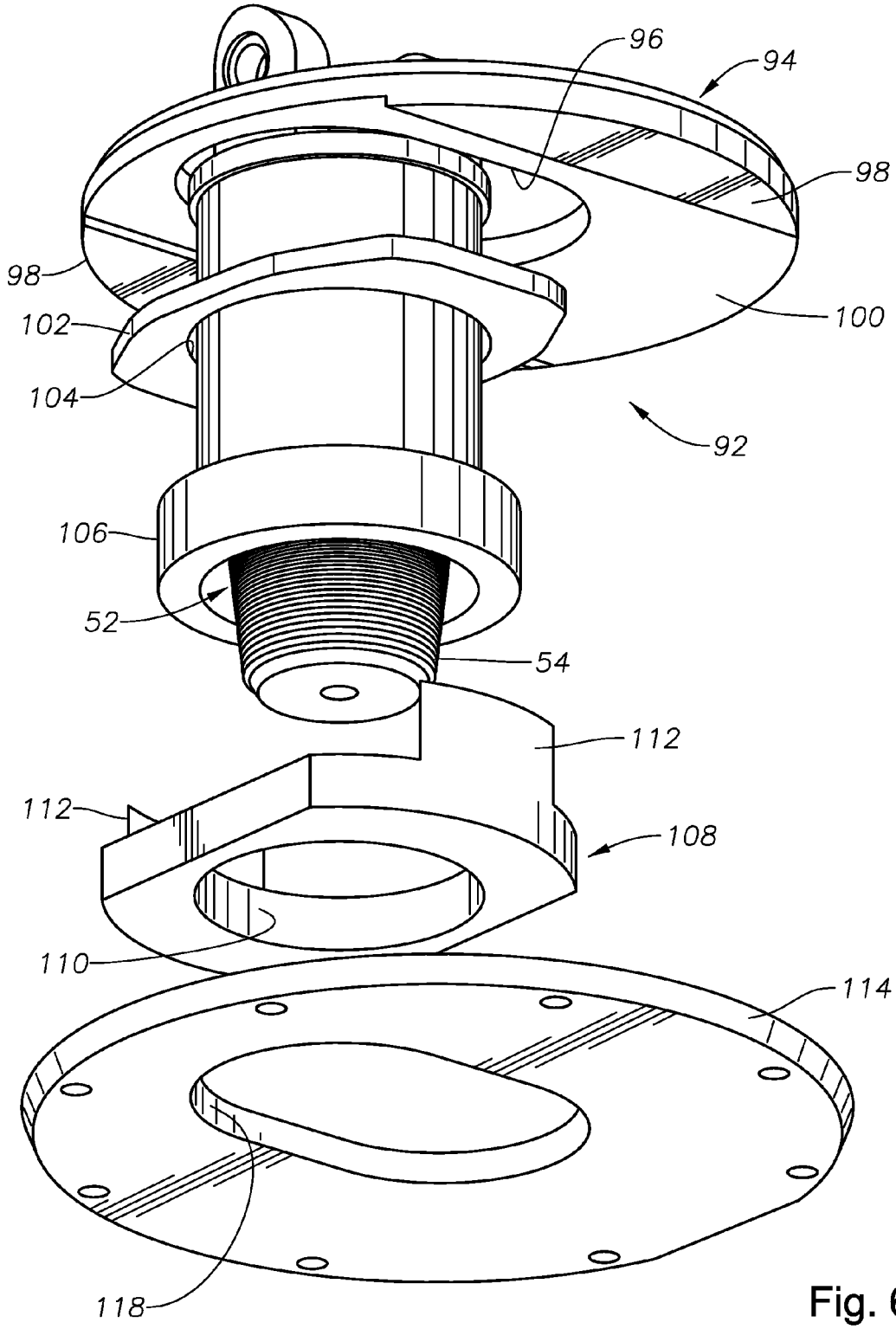
FIG. 6 is an exploded view of portions of an exemplary positioning assembly used within the retrieval tool shown in FIGS. 2A-2B.

In the described embodiment, the inner body 58 also contains a positioning assembly, which is generally indicated at 92. The positioning assembly 92 is used to angularly and laterally orient the attachment sub 52 to permit it to be aligned with and threadedly affixed to the remote tool 18. Some portions of the positioning assembly 92 are best understood with further reference to FIG. 6 which shows certain components of the positioning assembly 92 in an exploded view. Generally, the positioning assembly 92 includes a plurality of components that captively retain the attachment sub 52 and which are slidably moveable with respect to one another within the inner body 58 to govern the angular and lateral orientation of the attachment sub 52. The attachment sub 52 is retained captively within a number of openings that are disposed through these components. The exemplary positioning assembly 92 includes a set down plate 94 that is secured within the inner body 58. An opening 96 is disposed through the set down plate 94, and the attachment sub 52 extends through the opening 96. The opening 96 is elongated and large enough to permit the attachment sub 52 to be moved around within the opening 96. As can be seen in FIG. 6, two flanges 98 extend downwardly from the lower side of the set down plate 94 defining a channel 100 between them.

The exemplary positioning assembly 92 also includes a set down ring 102. The set down ring 102 has an opening 104, and the attachment sub 52 extends through the opening 104. The set down ring 102 is shaped and sized to fit within the channel 100 of the set down plate 94 and slide from edge to edge of the set down plate 94 within the channel 100.

The exemplary positioning assembly 92 also includes a load ring 106 that radially surrounds the attachment sub 52 and is located below the set down ring 102. In addition, a lower set down ring 108. The lower set down ring 108 has a central opening 110 through which the attachment sub 52 extends. In addition, the lower set down ring 108 has ridges 112 that project upwardly from the upper surface of the lower set down ring 108 and contact the flat edges of the set down ring 102.

Finally, the exemplary positioning assembly 92 includes a lifting ring 114 that is secured within the inner body 58 by a securing nut 116. The attachment sub 52 extends through an opening 118 in the lifting ring 114.

Fluid is able to pass downwardly through the running string 30 and the retrieval tool 28. The running string 30 defines a flowbore 120 along its length. The flowbore 120 interconnects with flow opening 122 within rotational drive element 60 and is directed into a flexible fluid conduit 124. The flexible conduit 124 passes through the upper flex joint yoke 70, the shaft assembly 72 and the lower flex joint yoke 78. The conduit then extends to a flow passage 126 that passes through the attachment sub 52. Thus, fluid may be pumped downwardly from the surface into the flowbore 120 of the running string 30 and it will exit the attachment sub 52. As a result, fluid pressure may be applied to the remote tool 18 as may be needed to, for example, release the tool 18 from locking interengagement with other tools within the wellbore 10. Once engaged, fluid pressure can be applied when the remote tool 18 relies on a hydraulic system to release it from the wellbore 10 or from other tools within the wellbore 10.

Figure 3A:
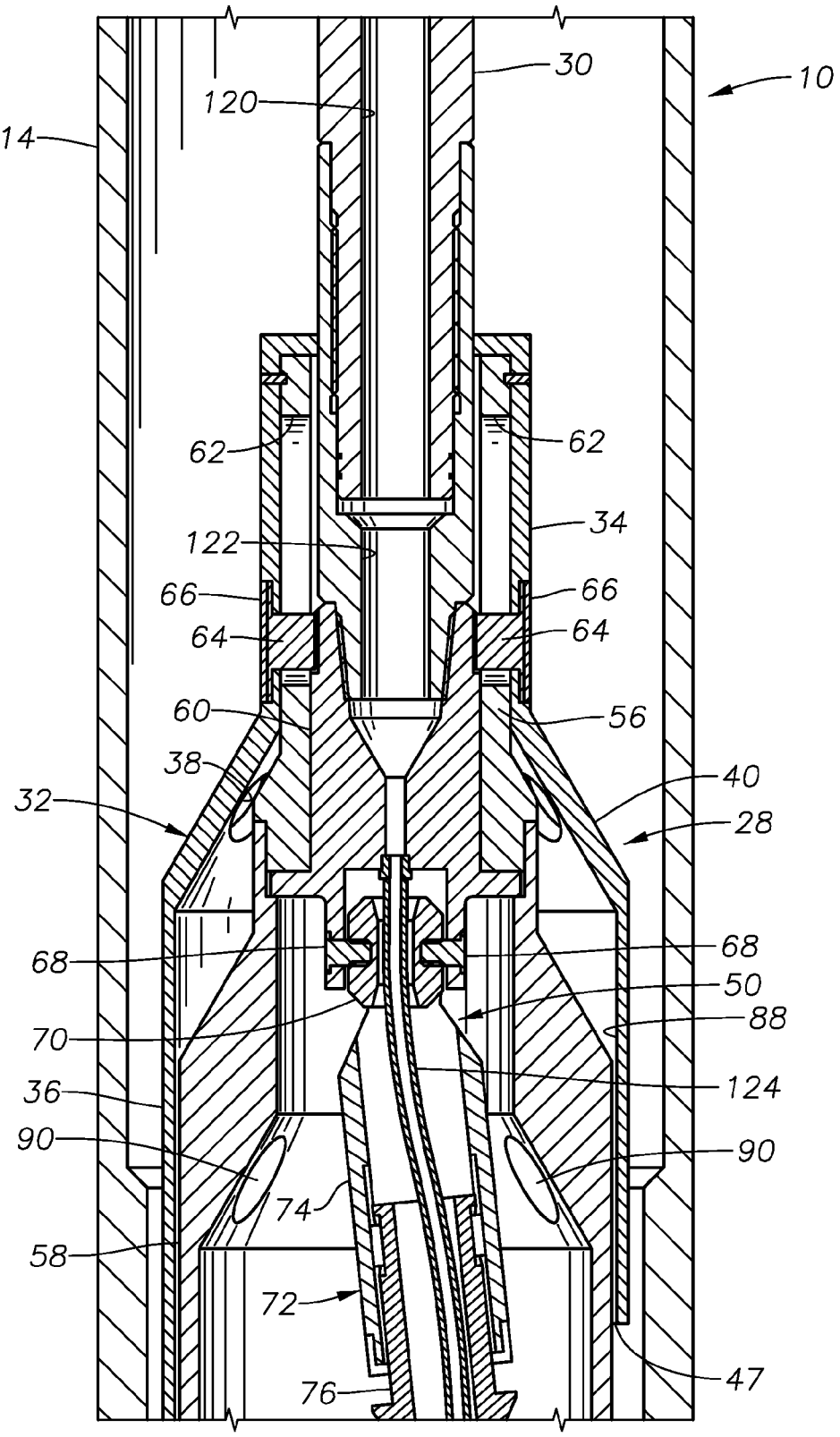
FIGS. 3A and 3B are an enlarged side, cross-sectional view of the retrieval tool and remote tool of FIG. 1 during tool orientation.
Figure 3B:
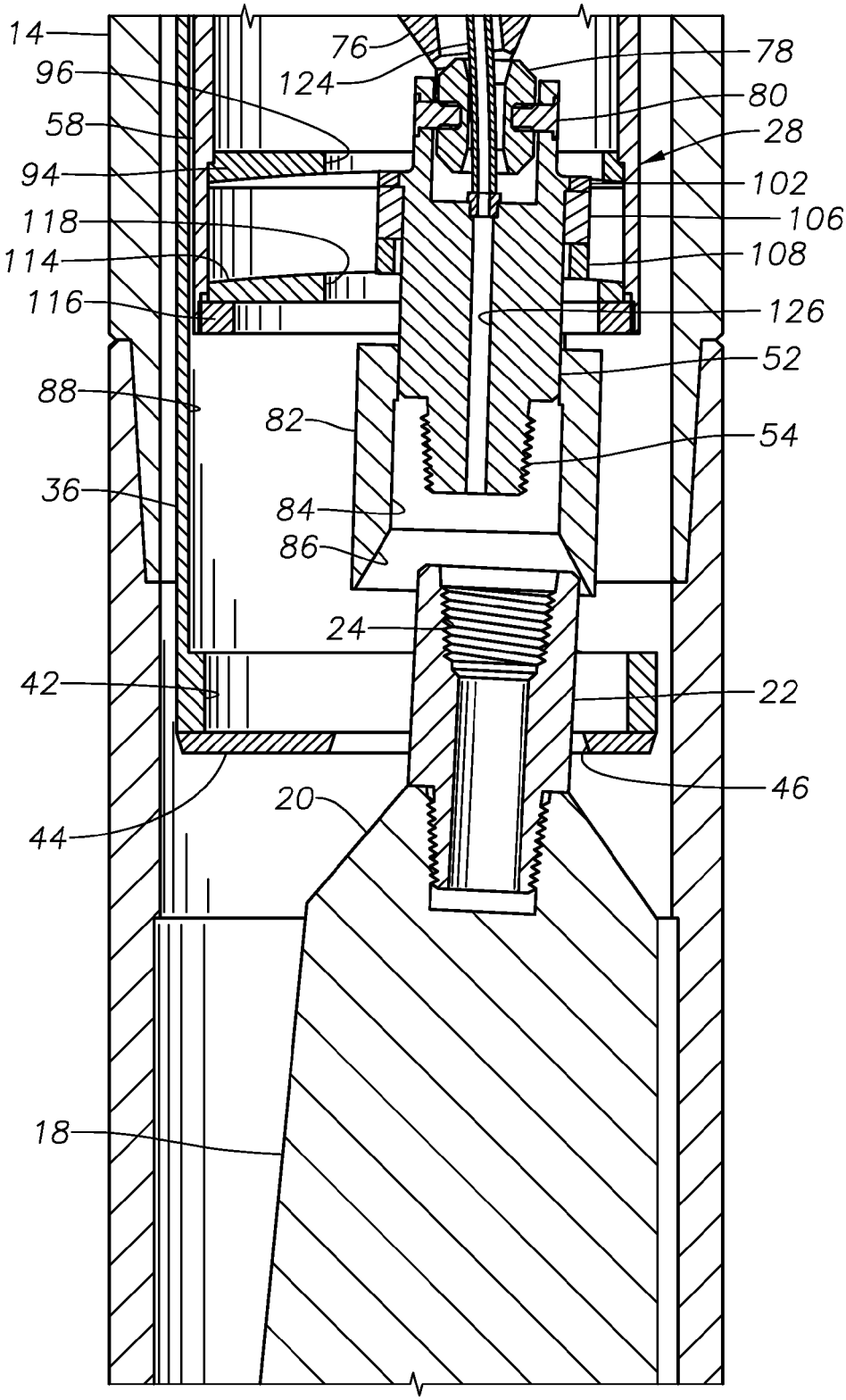
Figure 7:
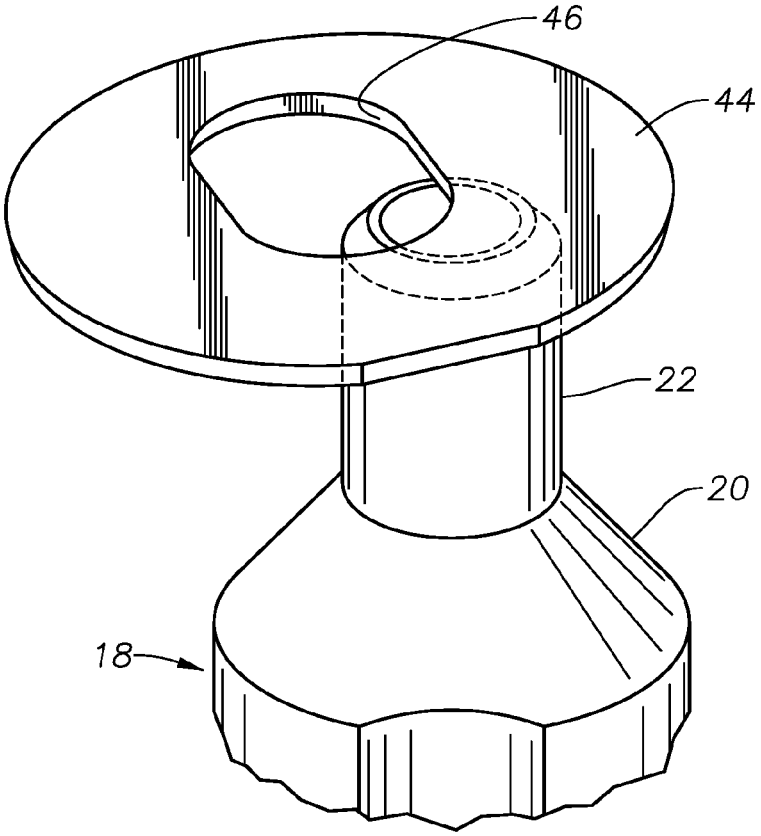
FIG. 7 is an isometric detail depicting the locating plate of the retrieval tool in contact with the neck portion of the remote tool.
Figure 8:
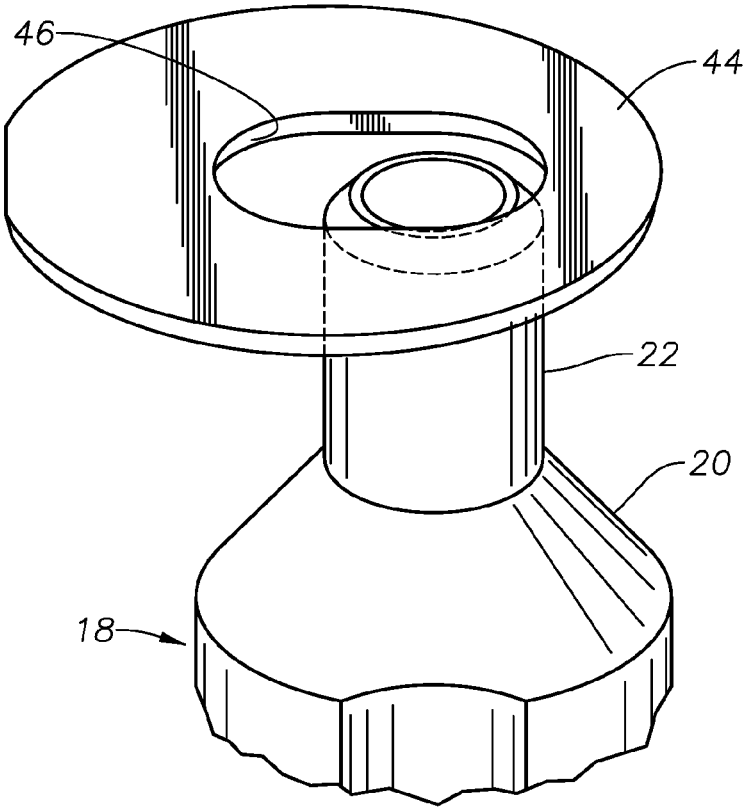
FIG. 8 is an isometric detail depicting the locating plate of the retrieval tool in contact with the neck portion of the remote tool and the opening of the locating plate aligned with the neck portion.

In an exemplary method of operation, the retrieval tool 28 is affixed to the running string 30 and disposed into the wellbore 10, as depicted in FIG. 1. The retrieval tool 28 is brought into contact with the remote tool 18. The locating plate 44 of the retrieval tool 28 will contact the neck portion 22 of the remote tool 18. Typically, the neck portion 22 will not be initially aligned with the opening 46 of the locating plate 44, as illustrated by FIG. 7. Because the shear members 48 are intact, rotation of the running string 30 will transmit torque at this point from the rotational drive element 60 to the outer housing 32, thereby causing the outer housing 32 to rotate with the running string 30. The running string 30 and affixed retrieval tool 28 are rotated until the opening 46 is aligned with the neck portion 22 (see FIG. 8). Once so aligned, the neck portion 22 will enter the opening 46, as shown in FIG. 3B, preventing further rotation of the outer housing 32 and providing an indication of correct orientation exhibited by an increase in torque. Continuing to lower the running string 30 into the wellbore 10 will bring the neck portion 22 into contact with the tapered edge 86 of the guide sleeve 82.

Figure 4A:
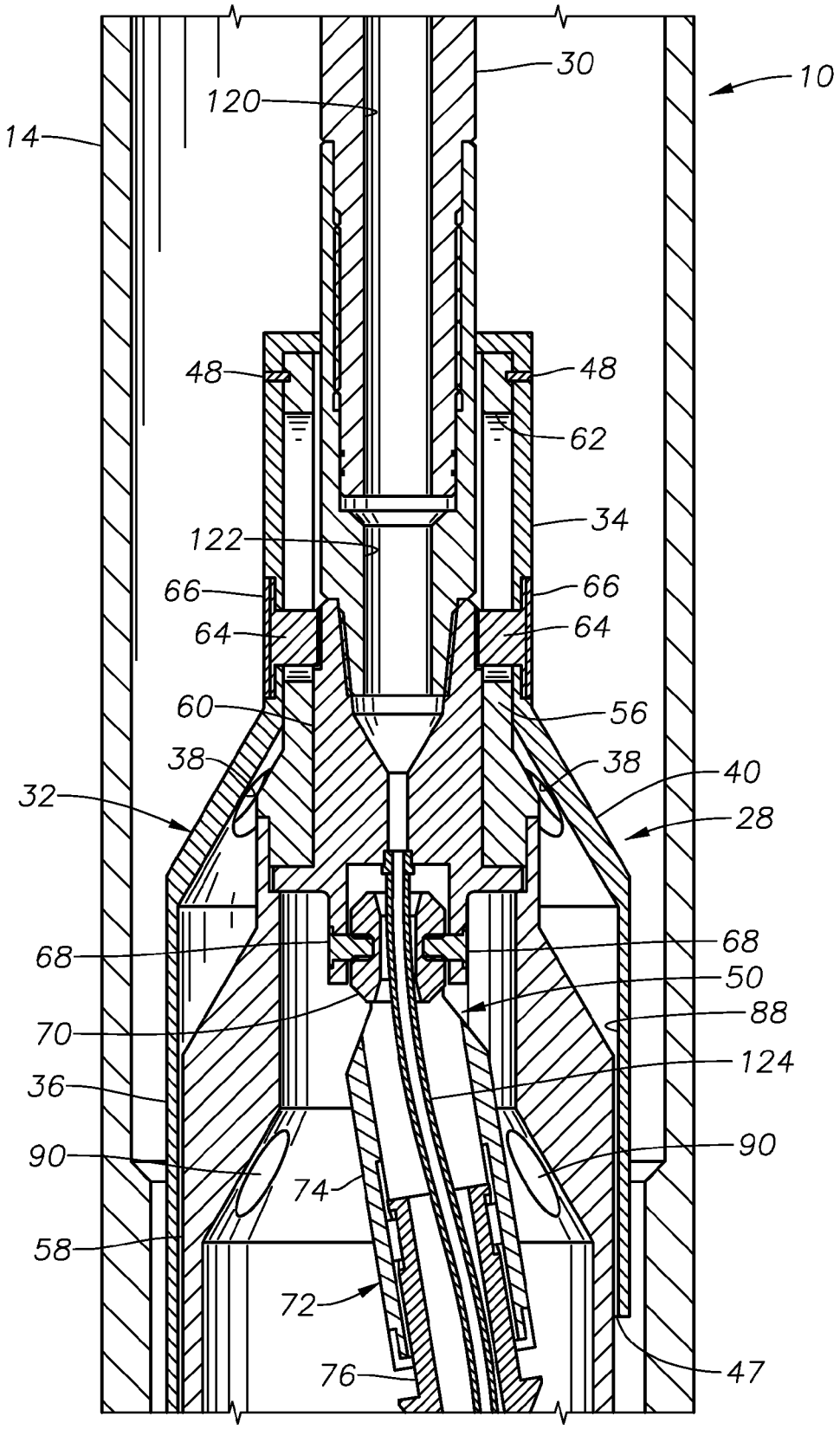
FIGS. 4A and 4B are an enlarged side, cross-sectional view of the retrieval tool and remote tool of FIG. 1, now with the locating plate having been landed.
Figure 4B:
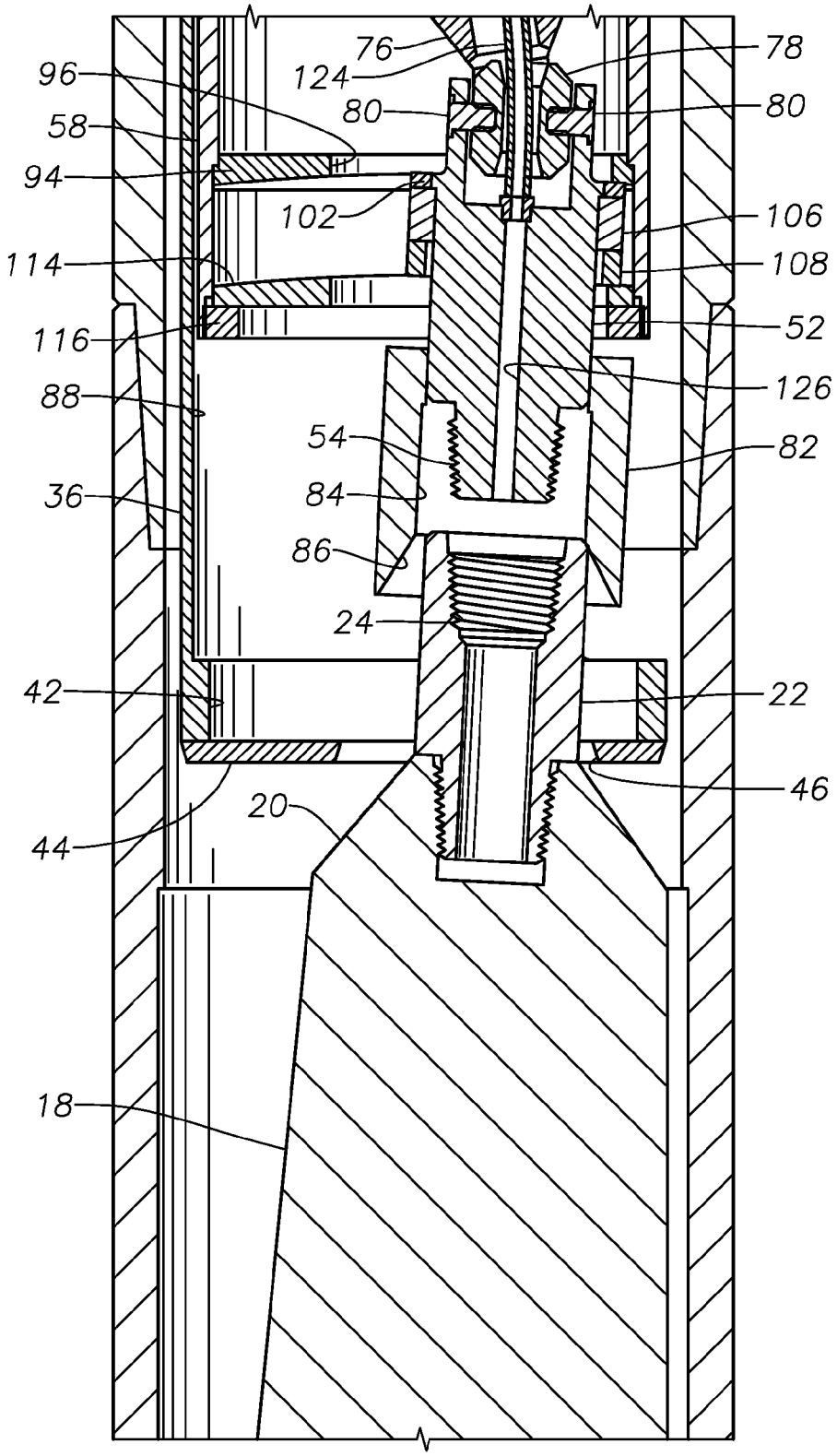

As the running string 30 and retrieval tool 28 are further lowered, the guide sleeve 82 and the attachment sub 52 move radially outwardly along the tapered edge 86, as depicted by FIG. 4B, the guide sleeve 82 functioning to guide the attachment sub 52 into alignment with the neck portion 22 of the remote tool 18. Once so aligned, further lowering of the running string 30 will bring the locating plate 44 into contact with the shoulder 20 of the remote tool 18 stopping further downward movement of the outer housing 32 and breaking the frangible shear members 48 of the clutch assembly. Once the clutch assembly is disengaged, the rotational drive element 60 is free to move and rotate within the outer housing 32 and further lowering and rotation of the running string 30 will thread the threaded portion 54 of the attachment sub 52 into the threaded portion 24 of the neck portion 22 of the remote tool 18. Because the frangible shear members 48 have been broken, torque is now transmitted from the rotational drive element 60 to the attachment sub 52 via the articulated shaft assembly 50 rather than to the outer housing 32.

Figure 5A:
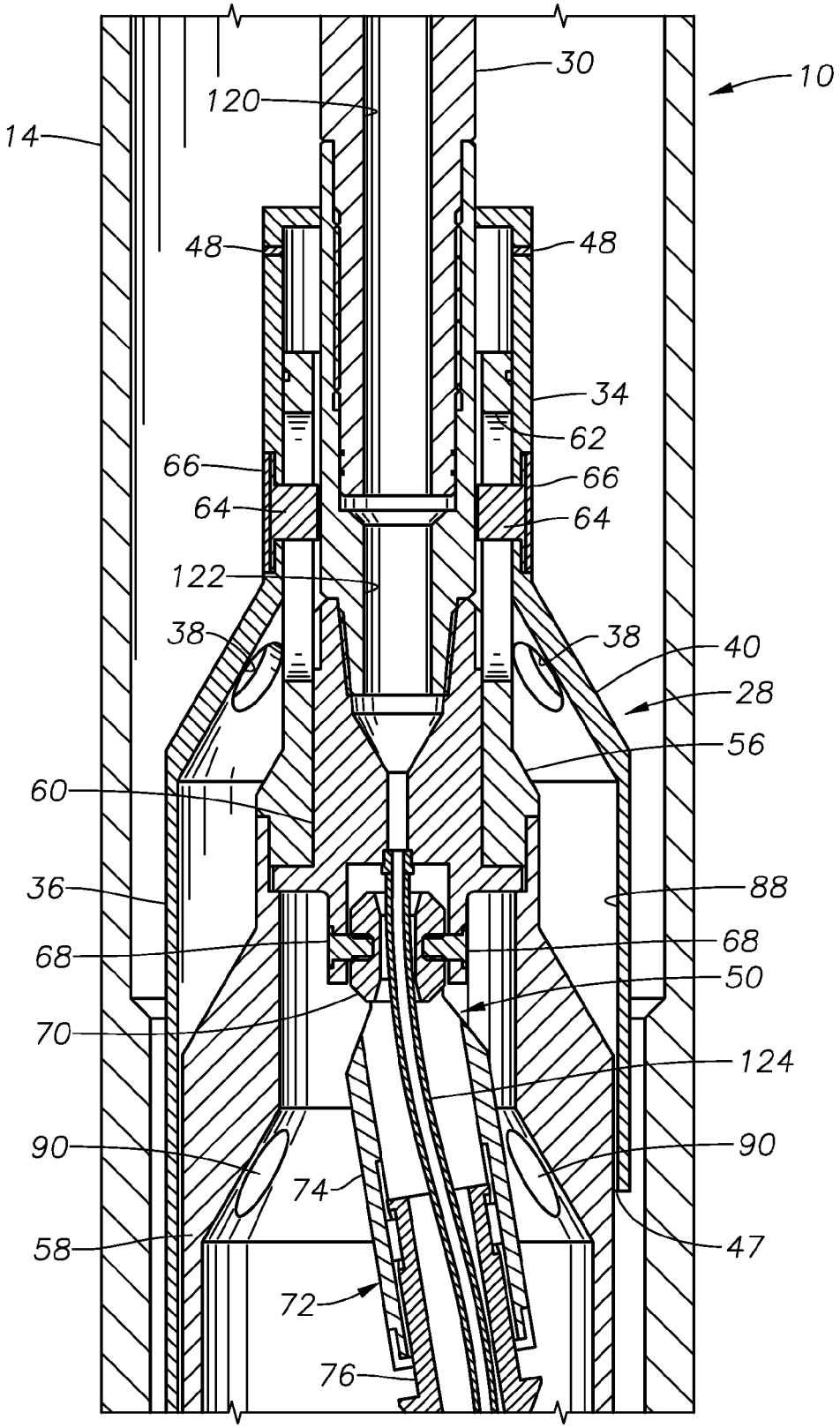
FIGS. 5A and 5B are an enlarged side, cross-sectional view of the retrieval tool and remote tool of FIG. 1, now with the attachment sub fully engaged with the remote tool.
Figure 5B:
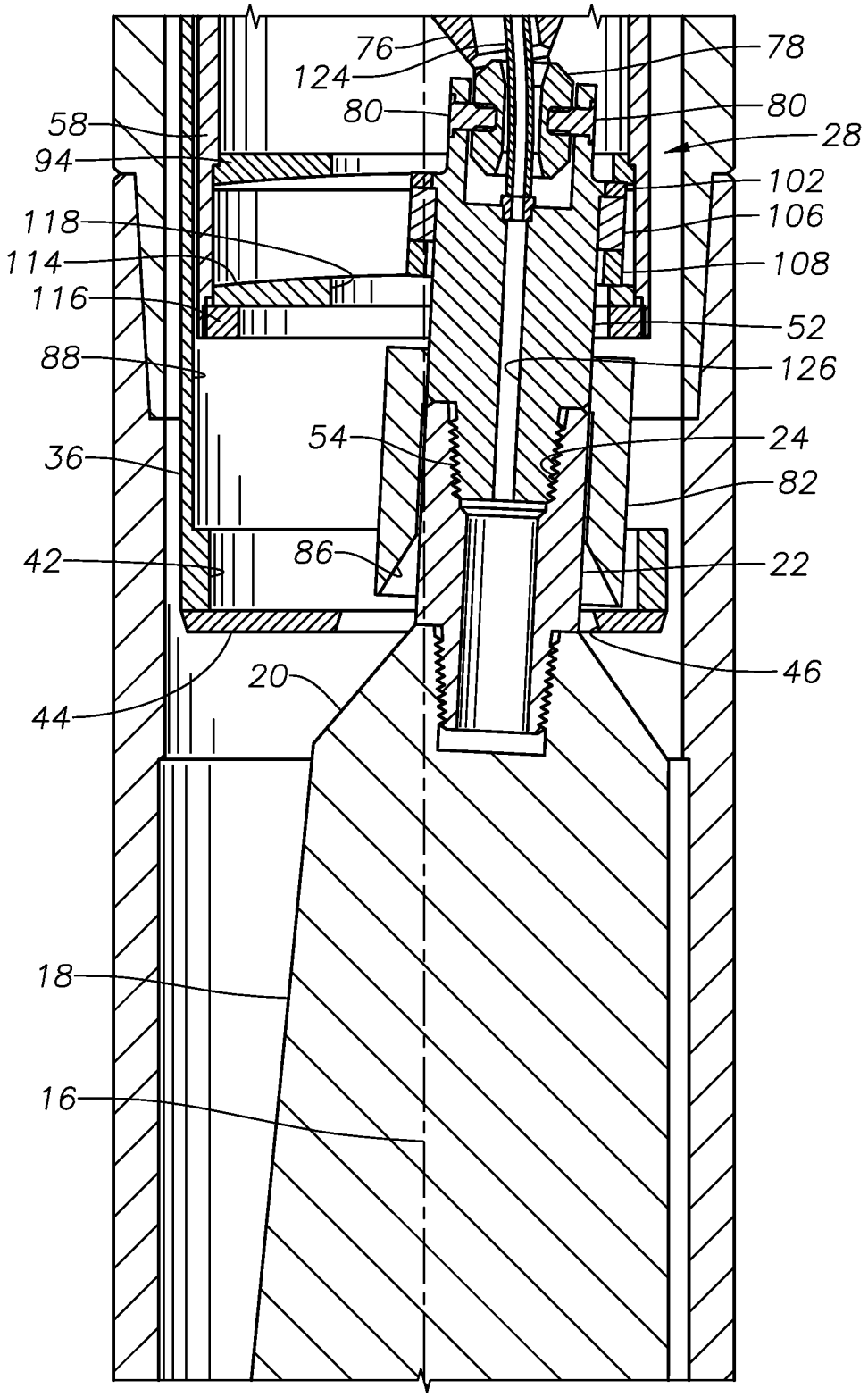

To aid in the threading operation, angular and lateral orientation of the attachment sub 52 is altered by the articulated shaft assembly 50 as well as governed by the positioning assembly 92. As the attachment sub 52 is urged into an off-center position by the guiding of guide sleeve 82, the shaft assembly 72 will pivot upon the upper and lower flex joint yokes 70, 78 as needed to allow the attachment sub 52 to achieve that position. Also, the shaft members 74, 76 of the shaft assembly 72 will move telescopically with respect to each other by extending or retracting as needed to accommodate angular or lateral movement of the upper (non-threaded) end of the attachment sub 52. In addition, the plates 94, 102 and rings 106, 108 and 114 of the positioning assembly 92 help orient the attachment sub laterally and angularly to assist with attachment to the remote tool 18. The attachment sub 52 is held captively within the openings 96, 104, 110 and 118 within the plates 94, 102 and rings 106, 108 and 114. Therefore, as these stacked members slide relative to each other, they govern lateral movement of the attachment sub (relative to the central axis 16) and, therefore, help it be threaded together with the angled neck portion 22 of the remote tool 18. This lateral and angular orientation can be seen by comparison of FIG. 3B, which depicts an orientation of the attachment sub 52 that is generally aligned with the central axis 16, with FIG. 5B, which shows an orientation that departs laterally from the central axis 16.

Once the remote tool 18 has been affixed to the retrieval tool 28, fluid pressure may be applied through the running string 30 as required to release the remote tool 18. The running string 30, retrieval tool 28 and remote tool 18 can then be removed from the wellbore 10 by pulling upwardly on the running string 30.

The foregoing description is directed to particular embodiments of the present invention for the purpose of illustration and explanation. It will be apparent, however, to those skilled in the art that many modifications and changes to the embodiment set forth above are possible without departing from the scope and the spirit of the invention.

What is claimed is:

1. A retrieval tool for forming a threaded connection with a remote tool within a remote location, the retrieval tool comprising:

a rotational drive element disposed along a central axis and affixed to a running string to dispose the retrieval tool into the remote location;

an attachment sub having a threaded portion for threadedly connecting with a threaded portion of the remote tool, the attachment sub being rotationally driven by the rotational drive element to form the threaded connection;

an articulated shaft assembly interconnecting the rotational drive element to the attachment sub to permit the attachment sub to move laterally and angularly with respect to the central axis, the articulated shaft assembly further comprising a first shaft member, a second shaft member disposed in a telescopic configuration with the first shaft member and wherein the first and second shaft members are moveable with respect to each other to extend and retract; and a fluid conduit carried by the retrieval tool to transmit fluid pressure to the remote tool.

2. The retrieval tool of claim 1 further comprising:

an outer housing that radially surrounds the rotational drive element, articulated shaft assembly and the attachment sub, the outer housing defining an interior chamber within which the attachment sub is located; and a locating plate incorporated into the outer housing and having an opening for receiving the threaded portion of the remote tool into the interior chamber for threaded connection to the attachment sub.

3. The retrieval tool of claim 2 wherein the outer housing is releasably secured to the rotational drive element by a frangible shear member and wherein:

a) torque is applied from the rotational drive element to the outer housing when the frangible shear member is intact; and b) torque is applied from the rotational drive element to the attachment sub when the shear member is ruptured.

4. The retrieval tool of claim 1 further comprising a guide sleeve radially surrounding the attachment sub and having a guiding portion for guiding the threaded portion of the remote tool into threaded engagement with the attachment sub.

5. The retrieval tool of claim 1 further comprising a positioning assembly to govern movement of the attachment sub laterally and angularly with respect to the central axis.

6. The retrieval tool of claim 5 wherein the positioning assembly comprises a plurality of stacked elements that captively retain the attachment sub and are slidably moveable with respect to each other in order to accommodate angular and lateral movement of the attachment sub.

7. A retrieval tool for forming a threaded connection with a remote tool within a remote location, the retrieval tool comprising:

a rotational drive element disposed along a central axis and affixed to a running string to dispose the retrieval tool into the remote location;

an attachment sub having a threaded portion for threadedly connecting with a threaded portion of the remote tool, the attachment sub being rotationally driven by the rotational drive element to form the threaded connection;

an articulated shaft assembly interconnecting the rotational drive element to the attachment sub to permit the attachment sub to move laterally and angularly with respect to the central axis; and a positioning assembly to govern movement of the attachment sub laterally and angularly with respect to the central axis.

8. The retrieval tool of claim 7 further comprising a fluid conduit carried by the retrieval tool to transmit fluid pressure to the remote tool.

9. The retrieval tool of claim 7 further comprising:

an outer housing that radially surrounds the rotational drive element, articulated shaft assembly and the attachment sub, the outer housing defining an interior chamber within which the attachment sub is located; and a locating plate incorporated into the outer housing and having an opening for receiving the threaded portion of the remote tool into the interior chamber for threaded connection to the attachment sub.

10. The retrieval tool of claim 9 wherein the outer housing is releasably secured to the rotational drive element by a frangible shear member and wherein:

a) torque is applied from the rotational drive element to the outer housing when the frangible shear member is intact; and b) torque is applied from the rotational drive element to the attachment sub when the shear member is ruptured.

11. The retrieval tool of claim 7 wherein the articulated shaft assembly comprises:

a first shaft member;

a second shaft member disposed in a telescopic configuration with the first shaft member; and wherein the first and second shaft members are moveable with respect to each other to extend and retract.

12. The retrieval tool of claim 7 further comprising a guide sleeve radially surrounding the attachment sub and having a guiding portion for guiding the threaded portion of the remote tool into threaded engagement with the attachment sub.

13. The retrieval tool of claim 7 wherein the positioning assembly comprises a plurality of stacked elements that captively retain the attachment sub and are slidably moveable with respect to each other in order to accommodate angular and lateral movement of the attachment sub.

14. A method of retrieving a remote tool having a threaded portion from a remote location, the method comprising the steps of:

affixing a retrieval tool to a running string, the retrieval tool having a) a rotational drive element disposed along a central axis and affixed to a running string to dispose the retrieval tool into the remote location;

b) an attachment sub having a threaded portion for threadedly connecting with a threaded portion of the remote tool, the attachment sub being rotationally driven by the rotational drive element to form the threaded connection;

c) an articulated shaft assembly interconnecting the rotational drive element to the attachment sub to permit the attachment sub to move laterally and angularly with respect to the central axis; and d) a fluid conduit carried by the retrieval tool to transmit fluid pressure to the remote tool disposing the retrieval tool into the remote location on the running string;

orienting the attachment sub laterally and angularly via the articulated shaft assembly to align the threaded portion of the attachment sub with the threaded portion of the remote tool;

accommodating angular and lateral movement of the attachment sub with a positioning assembly having a plurality of stacked elements that captively retain the attachment sub and that are slidably moveable with respect to each other;

threadedly securing the attachment sub to the remote tool by rotation of the running string;

applying fluid pressure to the remote tool via the fluid conduit; and withdrawing the running string, retrieval tool and remote tool from the remote location.

15. The method of claim 14 wherein the retrieval tool further comprises an outer housing that radially surrounds the rotational drive element, articulated shaft assembly and the attachment sub, the outer housing defining an interior chamber within which the attachment sub is located, and a locating plate incorporated into the outer housing and having an opening for receiving the threaded portion of the remote tool into the interior chamber for threaded connection to the attachment sub and wherein the method further comprises a step of:

rotating the outer housing to align the threaded portion of the remote tool with the opening in the locating plate;

receiving the threaded portion of the remote tool through the opening and into the interior chamber; and thereafter, threadedly securing the attachment sub to the remote tool.

16. The method of claim 15 further comprising a step of guiding the threaded portion of the remote tool into threaded engagement with the attachment sub with a guiding portion of a guide sleeve that radially surrounds the attachment sub.

17. The method of claim 14 further comprising a step of telescopically extending or retracting the articulated shaft assembly to permit the attachment sub to move laterally and angularly with respect to the central axis.

* * * * *